United States Patent [19]

Hosino et al.

[11] Patent Number: 4,910,114

[45] Date of Patent: Mar. 20, 1990

[54] TONER FOR ELECTROPHOTOGRAPHY

[75] Inventors: Yukihisa Hosino; Takeo Kudo, both of Hitachi, Japan

[73] Assignee: Hitachi Chemical Company, Ltd., Tokyo, Japan

[21] Appl. No.: 45,569

[22] Filed: May 4, 1987

[51] Int. Cl.[4] ..... G03G 9/08

[52] U.S. Cl. ..... 430/106.6; 430/109; 430/111; 526/934

[58] Field of Search ..... 430/106.6, 109, 111; 526/934

[56] References Cited

U.S. PATENT DOCUMENTS 3,965,021 6/1976 Clemens et al. ..... 430/109

FOREIGN PATENT DOCUMENTS 61-123854 6/1986 Japan ..... 430/109
61-200549 9/1986 Japan .
2070031 9/1981 United Kingdom ..... 430/109

*Primary Examiner*—Roland E. Martin
*Attorney, Agent, or Firm*—Antonelli, Terry & Wands

[57] ABSTRACT

A toner for electrophotography containing as a binder a polymer comprising as essential ingredient a high-molecular-weight monofunctional monomer having a weight average molecular weight of 1,000 to 50,000 and an ethylenic double bond only at one end of the molecular chain is excellent in fixing properties in a heat roll fixing process and anti-offset properties.

20 Claims, No Drawings

TONER FOR ELECTROPHOTOGRAPHY

BACKGROUND OF THE INVENTION

This invention relates to a toner for developing an electrostatic image in electrophotography and electrostatic recording.

The development processes for the electrostatic latent image are broadly classified into liquid development process and dry development process. The present invention relates to a toner for use in dry development process. Further, as for fixing the developed toner image on a support such as paper, there have been known methods of fixing by application of heat such as hot roll fixing, flashing, high frequency heating, and oven heating, by application of pressure by means of rolls, and by using an organic solvent. This invention relates to a toner particularly suitable for hot roll fixing.

Recent electrophotographic copiers generally adopt hot roll fixing for the reasons of high thermal efficiency, excellent fixing performance, good image quality, and compactness of the equipment. It is popular to use the hot roll fixing particularly in high speed fixing system. In the hot roll fixing, however, upon being heated, the toner becomes soft and tacky and a portion of it adheres to the hot roll surface, giving rise to a phenomenon called offset.

To keep the toner from offset various equipments and methods for fixing have heretofore been proposed. There is used, for example, a fixing equipment utilizing hot roll, the surface layer of which is made of a material having an excellent release property and, in addition, the surface layer is overcoated with an anti-offset liquid such as a silicone oil. Although efficient in preventing the offset phenomenon from occurring, such an equipment has disadvantages in that a disagreeable odor is emitted owing to degeneration of the anti-offset liquid, that the equipment is of a large size to accommodate the requisite feeding device for the anti-offset liquid and that an increase in the cost is resulted from the complicated mechanism of the equipment and the higher accuracy of the equipment required for the steady operation. Therefore, there has been made an effort to develop a method of preventing the offset phenomenon, requiring entirely no or only a small amount of anti-offset liquid which affects the cost insignificantly. For example, Japanese Patent Application "Kokai" (Laid-open) No. 65,231/74 discloses that the offset can be eliminated by incorporating a small amount of a low molecular weight polypropylene into the toner composition.

Regarding the binder for the toner, various attempts have also been made. For instance, it is disclosed in U.S. Pat. No. 3,941,878 that a polymer capable of crosslinking is used as binder and in U.S. Pat. Nos. 4,386,147 and 4,486,524 that a resin having a broad molecular weight distribution is used as binder. There are also described in Japanese Patent Application "Kokai" (Laid-open) Nos. 68,752/83 and 102,246/83 that a modified epoxy resin having a vinyl group and a vinyl-type polymer which is graft-copolymerized with a polyester resin having a vinyl group are used as binders, respectively.

However, when the low molecular weight polypropylene is used as an anti-offset agent, it is desirable to use the polymer in a least possible amount, because otherwise the toner tends to become non-uniform and cause dirty background or dusting. When the polymer capable of crosslinking and the graft copolymer are used as binder, a general tendency is a decline in fixing properties and such a tendency becomes more marked with the increase in fixing speed. When the polymer having a broad molecular weight distribution is used, although it is possible to prevent the offset phenomenon without injuring the fixing properties, a problem encountered is an economic disadvantage, because it is generally not easy to prepare such a resin.

SUMMARY OF THE INVENTION

An object of this invention is to solve the above-mentioned problems and provide a toner which meets the fundamental requirements for a toner, such as storage stability, charge receptivity, and the like, is excellent in adaptability to the hot roll fixing, such as fixing and anti-offset capabilities, and is easily produced.

The present invention provides a toner for electrophotography containing as binder a polymer comprising as essential ingredient a high molecular weight monofunctional monomer of 1,000 to 50,000 in weight average molecular weight and having an ethylenic double bond at one end of the molecular chain.

DESCRIPTION OF THE PREFERRED EMBODIMENTS

The high molecular weight monofunctional monomer used in this invention is polymer having an ethylenic double bond only at one end of the molecular chain.

The preparation of such a polymer can be accomplished by performing the anionic living polymerization of a vinyl-type monomer with anionic active species such as organolithium compounds (e.g. sec-butyllithium, n-butyllithium and ethyllithium), organomagnesium halides (e.g. n-butylmagnesium bromide, sec-butylmagnesium bromide, ethylmagnesium bromide, and phenylmagnesium bromide), or organosodium compounds (e.g. sodium naphthylide) in an aprotic solvent such as tetrahydrofuran, hexane, or benzene, or further allowing the resulting polymer to react with electrophilic compounds such as monoepoxy compounds (e.g. ethylene oxide, propylene oxide, and styrene oxide) to yield a living polymer having an active site at one end, and then allowing the resulting living polymer to react with an equivalent or approximately equivalent amount of a compound having (a) a radical-polymerizable ethylenic double bond and (b) a functional group capable of undergoing the nucleophilic substitution reaction with said living polymer. As such compounds, mention may be made of methacryloyl or acryloyl halides such as methacryloyl chloride and acryloyl chloride; acid anhydrides such as methacrylic anhydride, acrylic anhydride, maleic anhydride, phthalic anhydride, and itaconic anhydride; and o-, m- or p-(haloalkyl)styrenes such as o-, m- or p-(chloromethyl)styrene and o-, m-, or p-(bromomethyl)styrene. In view of good radical-polymerizability, preferred compounds are methacryloyl chloride, acryloyl chloride, o-, m- or p-(chloromethyl)styrene and o-, m- or p-(bromomethyl)styrene, though other compounds are not excluded.

The method for preparing the living polymer and the method for introducing a radical-copolymerizable vinyl group are not limited to those described above. Further, in this invention, the method of preparing a high molecular weight monofunctional monomer is not limited to the method utilizing an active living polymer but any of the methods capable of yielding said monomer can be used.

In this invention, the weight average molecular weight of the high molecular weight monofunctional monomer is 1,000 to 50,000, preferably 5,000 to 30,000. If the weight average molecular weight is below 1,000, the effect of preventing offset phenomenon becomes inferior, whereas if it exceeds 50,000, the fixing ability becomes inferior. The weight average molecular weight as herein referred to is that determined by the gel permeation high performance liquid chromatography (abbreviated to GPC) by referring to a calibration curve plotted by using a standard polystyrene.

In the case where the active living polymers are used in the production of high molecular weight monofunctional monomers, the vinyl-type monomers necessary as raw material include styrene and styrene derivatives such as α-methylstyrene, p-methylstyrene, and p-tert-butylstyrene; α,β-unsaturated esters such as methyl methacrylate, ethyl methacrylate, propyl methacrylate, butyl methacrylate, hexyl methacrylate, octyl methacrylate, dodecyl methacrylate, glycidyl methacrylate, dimethylaminoethyl methacrylate, diethylaminoethyl methacrylate, morpholinoethyl methacrylate, methyl acrylate, ethyl acrylate, butyl acrylate, hexyl acrylate, octyl acrylate, dodecyl acrylate, glycidyl acrylate, dimethylaminoethyl acrylate, diethylaminoethyl and morpholinoethyl acrylate; and conjugated dienes such as butadiene and isoprene, though other vinyl-type monomers are not excluded. In view of the excellent charge receptivity, fixing characteristics and anticaking properties of the toner, it is preferred to use styrene or styrene derivatives such as α-methylstyrnne, p-methylstyrene and p-tert-butylstyrene in preparing the living polymers. It is, therefore, desirable that the high molecular weight monofunctional monomer contains styrene and/or a styrene derivative in the molecule because of good fusion characteristics.

The polymer comprising as essential ingredient a high molecular weight monofunctional monomer can be that obtained from a high molecular weight monofunctional monomer alone, but is preferably that obtained by polymerizing a mixture of 0.1 to 50, preferably 1 to 40, % by weight of a high molecular weight monofunctional monomer and 50 to 99.9, preferably 60 to 99, % by weight of another polymer copolymerizable with said high molecular weight monofunctional monomer, said mixture amounting to 100% by weight.

The monomers copolymerizable with the high molecular weight monofunctional monomer according to this invention include styrene and styrene derivatives such as α-methylstyrene, p-methylstyrene, p-tert-butyl styrene, and p-chlorostyrene; methacrylic acid, methyl methacrylate, ethyl methacrylate, propyl methacrylate, butyl methacrylate, pentyl methacrylate, hexyl methacrylate, heptyl methacrylate, octyl methacrylate, nonyl methacrylate, decyl methacrylate, undecyl methacrylate, dodecyl methacrylate, glycidyl methacrylate, methoxyethyl methacrylate, propoxyethyl methacrylate, butoxyethyl methacrylate, methoxydiethylene glycol methacrylate, methoxyethylene glycol methacrylate, butoxytriethylene glycol methacrylate, methoxydipropylene glycol methacrylate, phenoxyethyl methacrylate, phenoxydiethylene glycol methacrylate, phenoxytetraethylene glycol methacrylate, benzyl methacrylate, cyclohexyl methacrylate, tetrahydrofurfuryl methacrylate, dicyclopentenyl methacrylate, dicyclopentenyloxyehyl methacrylate, N-vinyl-2-pyrrolidone methacrylate, methacrylonitrile, methacrylamide, N-methylolmethacrylamide, 2-hydroxyethyl methacrylate, hydroxypropyl methacrylate, hydroxybutyl methacrylate, 2-hydroxy-3-phenyloxypropyl methacrylate, acrylic acid, methyl acrylate, ethyl acrylate, propyl acrylate, butyl acrylate, pentyl acylate, hexyl acrylate, heptyl acrylate, octyl acrylate, nonyl acrylate, decyl acrylate, undecylacrylate, dodecyl acrylate, glycidyl acrylate, methoxyethyl acrylate, propoxyethyl acrylate, butoxyethyl acrylate, methoxydiethylene glycol acrylate, methoxyethylene glycol acrylate,butoxytriethylene glycol acrylate, methoxydipropylene glycol acrylate, phenoxyethyl acrylate, phenoxydiethylene glycol acrylate, phenoxytetraethylene glycol acrylate, benzyl acrylate, cyclohexyl acrylate, tetrahydrofurfuryl acrylate, dicyclopentenyl acrylate, dicyclopentenyloxyethyl acrylate, N-vinyl-2-pyrrolidone acrylate, hydroxyethyl acrylate, hydroxypropyl acrylate, hydroxybutyl acrylate, 2-hydroxy-3-phenyloxypropyl acrylate, glycidyl acrylate, acrylonitrile, acrylamide, N-methylolacrylamide, diacetoneacrylamide, and vinylpyridine. These monofunctional vinyl monomers having one vinyl group in one molecule are used as principal ingredient, but it is also possible to use those multifunctional vinyl monomers which have two or more vinyl groups in one molecule, such as divinylbenzene; reaction products of glycols and methacrylic acid or acrylic acid such as, for example, ethylene glycol dimethacrylate, 1,3-butylene glycol dimethacrylate, 1,4-butanediol dimethacrylate, 1,5-pentanediol dimethacrylate, 1,6-hexanediol dimethacrylate, neopentyl glycol dimethacrylate, diethylene glycol dimethacrylate, triethylene glycol dimethacrylate, polyethylene glycol dimethacrylate, tripropylene glycol dimethacrylate, hydroxypivalic acid neopentyl glycol ester dimethacrylate, trimethylolethane trimethacrylate, trimethylolpropane trimethacrylate, pentaerythrit trimethacrylate, pentaerythrit tetramethacrylate, trismethacryloxyethyl phosphate, bis(methacryloyloxyethyl)hydroxyethyl isocyanurate, tris(methacryloxyethyl) isocyanurate, ethylene glycol diacrylate, 1,3-butylene glycol diacrylate, 1,4-butanediol acrylate, 1,5-pentanediol diacrylate, 1,6-hexanediol diacrylate, neopentyl glycol diacrylate, diethylene glycol diacrylate, triethylene glycol diacrylate, polethylene glycol diacrylate, tripropylene glycol diacrylate, hydroxypivalic acid neopentyl glycol ester diacrylate, trimethylolethane triacrylate, pentaerythrist triacrylate, pentaerythrit tetraacrylate, trisacryloxyethyl phosphate, bis(methacryloyloxyethyl)hydroxyethyl isocyanurate, tris(methacryloyloxyethyl)isocyanurate, half-ester of glycidyl methacrylate with methacrylic or acrylic acid, half-ester of bisphenol-base epoxy resin with methacrylic or acrylic acid, and half-ester of glycidyl acrylate with methacrylic acid or acrylic acid.

Of the above-listed compounds, desirable monofunctional vinyl monomers having one vinyl group in one molecule are styrene, styrene derivatives and mathacrylate or acrylate esters; particularly preferred are styrene and alkyl methacrylates or acrylates having 1 to 5 carbon atoms intthe alkyl group. Desirable multifunctional vinyl monomers having two or more vinyl groups in one molecule are divinylbenzene and alkylene glycol dimethacrylates or diacrylates having 2 to 6 carbon atoms in the alkylene group. Such multifunctional vinyl monomers should be used in an amount of 0 to 1% by weight in order to keep the fixing characteristics of the toner within required limits.

In this invention, a mixture of the high molecular weight monofunctional monomer and other monomer copolymerizable therewith is radical-polymerized with peroxide-type radical initiators such as benzoyl peroxide, 2-ethylhexy perbenzoate, lauroyl peroxide, di-tert-butyl peroxide, cumene hydroperoxide, methyl ethyl ketone peroxide, 4,4,6-trimethylcyclohexanone di-tert-butylperoxyketal, cyclohexanone peroxide, methylcyclohexanone peroxide, acetylacetone peroxide, cyclohexanone di-tert-butylperoxyketal, 2-octanone ditert-butylperoxyketal, diisopropyl hydroperoxide, acetyl peroxide, isobutyryl peroxide, and octanoyl peroxide; and azo-type radical initiators scch as 2,2'-azobisisobutyronitrile, 2,2'-azobis(2,4-dimethylvaleronitrile), dimethyl 2,2'-azobisisobutyrate, and 1,1'-azobis(-cyclohexane-1-carbonitrile).

The polymer in this invention can be prepared by any of the known methods of polymerization such as suspension polymerization, solution polymerization, emulsion polymerization, and bulk polymerization. Of the known polymerization methods, perticularly preferred is aqueous suspension polymerization from the viewpoint of economy and the stability during manufacture. In this method, use is made of water-soluble polymeric dispersants such as partially saponified polyvinyl alcohol, alkylcellulose, hydroxyalkylcellulose, carboxyalkylcellulose, polyacrylamide, polyvinylpyrrolidone, polyacrylic acid and alkali metal salts thereof, polymethacrylic acid and alkali metal salts thereof; and difficultly-soluble inorganic dispersants such as calcium phosphate, hydroxyapatite, magnesium phosphate, magnesium pyrophosphate, calcium carbonaee, barium sulfate, and hydrophobic silica. To improve the toner characteristics, it is desirable to regulate the polymerization so that the polymer may have a ratio of $\overline{M}w/\overline{M}n$ [($\overline{M}w$=weight average molecular weight)÷($\overline{M}n$=number average molecular weight)]of 2 to 30 and a glass transition temperature of 50° to 70° C. The weight average and number average molecular weights are determined by gel permeation chromatography and referring to a calibration curve plotted by using a standard molecular weight polystyrene.

The binder of this invention is prepared preferably by mixing 1 to 100% by weight of the above polymer and 99 to 0% by weight of other resins to form 100% by weight of a mixture. If the above polymer is used in too small an amount, the fixing characteristics and anti-offset properties become unsatisfactory. The other resins include known resins such as, polystyrene resins, copolystyrene-acrylic resins, silicone resins, polyester-carbonate resins, xylene rssins, epoxy resins, phenolic resins, iiene-base resins, coumarone resins, amide resins, and urethane resins.

The binder of this invention can be incorporated with colorants and/or magnetic powders, and, if necessary, other additives such as charge controlling agents in appropriate amounts.

The colorants include known pigments and dyes such as carbon black, iron oxides pigments, Phthalocyanine Blue, Phthalocyanine Green, Rhodamine 6G Lake, Watchung Red Barium and Watchung Red Strontium. The colorant is used in an appropriate amount of 1 to 60% by weight of the toner.

As magnetic powders, there may be used powdered metals such as iron, manganese, nickel and cobalt and ferrite of metals such as iron, manganese, nickel, cobalt and zinc. The average particle diameter of the magnetic powder is generally 10 μm or below, preferably 1 μm or below. The magnetic powder is used in an amount of 1 to 80% by weight of the toner. When a colorant and a magnetic powder are used in combination, either of them can be used in an amount below 1% by weight of the toner.

The charge controlling agents include nigrosine dyes, fatty acid-modified nigrosine dyes, metal complex nigrosine dyes, metal complex fatty acid-modified nigrosine dyes, and chromium complex of 3,5-di-tert-butylsalicylic acid. These agents are used in an amount of 0 to 20% by weight of the toner.

Other additives include powdered silica, powdered hydrophobic silica, polyolefins, paraffin wax, fluorocarbon compounds, fatty acid esters, partially saponified fatty acid esters, and metal salts of fatty acids. Such additives are used in an amount of generally 0 to 10% by weight of the toner.

The above-noted materials are mixed, for example, in the following way to from a toner for electrophotography.

The weighed materials are premixed in a W cone, V blender or Henschel mixer and the premix is milled by means of pressure kneader, banbury mixer, hot rolls, or extruder at a temperature at which the resulting mixture will melt. After having been cooled down, the mixture is coarsely crushed in a feather mill, pin mill, pulverizer, or hammer mill. The crushed mixture is finely ground by means of jet air mill. The resulting fine powder is screened by means of a classifier such as Acucut or Alpine classifier to obtain screened fine powder of preferably 5 to 30 μm in particle size. Flow regulator such as powdered silica can be directly compounded.

The polymer of this invention comprising as essential ingrddient a high molecular weight monofunctional monomer has a structure in which a high molecular weight side chain originated from the high molecular weight monofunctional monomer is attached as a branch to the main chain. As a consequence, the effect of intertwining of the polymer molecules becomes intensified, resulting in an increased elasticity; when such a binder is used as an ingredient of a toner, the latter is imparted with excellent anti-offset properties. Moreover, because such a polymer is fundamentally non-crosslinking, it exhibits good flow properties in molten state and the toner is imparted with improved fixing properties.

EXAMPLES

The invention is illustrated in detail below with reference to Examples, but the invention is not limited thereto.

1. Preparation of high molecular-weight monofunctional monomer:

The preparation was carried out according to the method of G. O. Schulz and R. Mikovich [J. Applied Polym. Sci., Vol. 27, 4773–4786 (1982)].

A 3-liter four-neck flask provided with a vacuum-tight stirrer, a three-way cock, a condenser and an inlet tube was purged with argon. Into the flask, were charged distilled benzene, diphenylethylene, and excess sec-butyllithium. The flask containing the mixture was left standing overnight. To the mixture discharged from the flask, were added 1,000 ml of benzene, which had been dried with lithium aluminum hydride and distilled, and 0.04 g of 1,1-diphenylethylene. To the mixture, was added dropwise and slowly 1.5-M solution of sec-butyllithium in cyclohexane from a syringe until a bright yellowish brown color in the flask had no longer disappeared. Then, 6.0 ml (9.0 mmoles) of 0.15-M solution of sec-butyllithium in cyclohexane was similarly added. Into the flask, was added slowly dropwise from a syringe 83.2 g (0.8 mole) of styrene, which had been dried with calcium hydride and distilled, so that the temperature in the flask may be held at 40° C. After 30 minutes of stirring, the reactor was cooled down to 20° C. To the reactor, was added 1 ml of liquid ethylene oxide from a syringe, whereupon the styryl anion changed into the alkoxy anion, accompanying complete disappearance of the orange color. Into the reactor heated to 40° C., was added from a syringe 2 ml of methacryloyl chloride which had been distilled under reduced pressure.

The reaction mixture was poured into 1,000 ml of methanol. The precipitated reaction product was allowed to settle, filtered under reduced pressure and dried at room temperature under reduced pressure to yield 87.2 g of a product. The product (designated HMM-1) was tested for the molecular weight by GPC using mono-dispersed polystyrene as reference. The weight average molecular weight and the number average molecular weight were found to be 9,300 and 8,500, respectively, and, hence, the ratio of $\overline{M}w/\overline{M}n$ was 1.09.

The molecular weight determination was performed under the following conditions:

Apparatus: Hitachi 635 (Hitachi, Ltd.)

Column: Three columns, each 10.7 mmϕ×30 cm, connected in series, packed with Gel-Pack® R440, R450 and 400M (Trade name, Hitachi Chemical Co.).

Column pressure: 35 kgf/cm$^2$

Flow rate: 203 ml/min.

Detector: Refractive Index detector.

HMM-2, HMM-3 and HMM-4 were prepared in the same manner as described above, except that the amount used of sec-butyllithium was varied. The amount of secbutyllithium and the molecular weight determined by GPC were as shown in the following table.

| | HMM-1 | HMM-2 | HMM-3 | HMM-4 |
|---|---|---|---|---|
| sec-Butyllithium (mmole) | 9.0 | 4.0 | 2.0 | 20.0 |
| Weight average mol. wt. ($\overline{M}w$) | 9,300 | 21,000 | 42,800 | 4,300 |
| Number average mol. wt. ($\overline{M}n$) | 8,5000 | 19,800 | 40,800 | 4,000 |
| $\overline{M}w/\overline{M}n$ | 1.09 | 1.06 | 1.05 | 1.08 |

2. Preparation of copolymer:

Into a 3-liter cylindrical separable flask provided with a stirrer having an H-form impeller, a condenser, a gas inlet and a thermometer, were charged 750 ml of tap water, 45 g of Supertite (hydroxyapatite, a dispersant for aqueous liquid, made by The Nippon Chemical Industries Co.), 4.5 g of a 1-% (by weight) aqueous dodecylbenzenesulfonate solution, and 2.25 g of a 10-% (by weight) aqueous sodium chloride solution. A solution was prepared by mixing together 50 g of HMM-1, 350 g of styrene, 100 g of butyl acrylate, and 15 g of benzoyl peroxide. The resulting solution was added to the 3-liter separable flask.

Nitrogen was introduced into the separable flask and the flask was stirred for about 30 minutes at room temperature to stabilize the dispersion. Then, the temperature was raised to 90° C. over a period of about one hour, stirred at this temperature for 4 hours and then at 95° C. for 2 hours to complete the polymerization. The polymerization mixture was then cooled down to 50° C., while being stirred, and admixed with 10 ml of concentrated hydrochloric acid to reduce pH of the aqueous phase to 3 or below. The mixture was filtered under reduced pressure, washed three times with 500 ml of tap water, and dried overnight in a drier at 50° C. to yield a polymer in bead form, which was designated TR-1.

Polymers shown in the following table were prepared in the same manner as described above, except that various monomer mixtures were used. The glass transition temperature shown in the table was the temperature (°C.) of incipient heat absorption, as determined by a differential scanning calorimeter (DSC). The softening point (°C.) was that determined by a thermomechanical analyzer (TMA) (sensitivity, 8 g).

TABLE 1

| | Monomer composition and physical properties of copolymer | | | | | | | | |
|---|---|---|---|---|---|---|---|---|---|
| Copolymer No. | TR-1 | TR-2 | TR-3 | TR-4 | TR-5 | TR-6 | TR-7 | TR-8 | TR-9 |
| Monomer composition | | | | | | | | | |
| Styrene (g) | 350 | 350 | 375 | 350 | 375 | 390 | 325 | 397.5 | 400 |
| Butyl acrylate (g) | 100 | 100 | 100 | 100 | 100 | 100 | 100 | 100 | 100 |
| HMM - 1 (g) | 50 | — | — | — | — | — | — | — | — |
| HMM - 2 (g) | — | 50 | 25 | — | — | — | — | — | — |
| HMM - 3 (g) | — | — | — | 50 | 25 | 10 | — | — | — |
| HMM - 4 (g) | — | — | — | — | — | — | 75 | — | — |
| Divinylbenzene (g) | — | — | — | — | — | — | — | 2.5 | — |
| Physical properties of copolymer | | | | | | | | | |
| $\overline{M}w$ | 155,000 | 168,000 | 132,000 | 176,000 | 154,000 | 128,000 | 107,000 | * | 36,000 |
| $\overline{M}n$ | 49,000 | 57,000 | 52,000 | 58,000 | 54,000 | 47,000 | 32,000 | * | 17,000 |
| $\overline{M}w/\overline{M}n$ | 3.2 | 2.9 | 2.5 | 3.0 | 2.9 | 2.7 | 3.3 | * | 2.1 |
| Glass trans. temp.** (°C.) | 58 | 58 | 57 | 59 | 58 | 57 | 57 | 65 | 55 |
| Softening point (°C.) | 77 | 79 | 75 | 80 | 77 | 74 | 72 | 85 | 68 |

*Undeterminable by GPC because of insolubility of the sample.

**Conditions of measurement: Method of thermomechanical analysis (penetration mode, load 70 g · f/cm$^2$; rate of temperature rise 10° C./min.).

3. Preparation of toner and developer

A mixture of 450 g of a copolymer, 40 g of carbon black #44 (Mitsubishi Chemical Industries, Ltd.), 10 g of Viscol 550P (low molecular weight polypropylene of Sanyo Chemical Industries, Ltd.) and 25 g of Oil Black BY (a nigrosine dye of Orient Chemical Co.) was melt-milled in a "Ko-Kneader", then crushed in a hammer mill and finely ground in a jet air mill. The finely ground mixture was screened to collect a toner having a particle diameter of 5 to 30 μm and an average particle diameter of 14 μm.

A blend of 50 g of the toner and 950 g of a carrier EFV 200/300 (an amorphous powdered iron oxide carrier of Nippon Teppun Co.) was thoroughly mixed by shaking to obtain a developer.

image had been transferred, had become 0.2% or more compared to the initial density of the solid black area.

4.3 Copying test on a commercial copier

A copying machine SF 755 (Sharp Corp.) was loaded with a developer under test and a continuous copying test was run t obtain 8,000 copies. The copies at an early stage of run were inspected and the changes in image were noted throughout the run.

The results of evaluation of toners were as shown in the following Table.

TABLE 2

| | Results of evaluation of toner | | | | | | | | |
|---|---|---|---|---|---|---|---|---|---|
| | Example No. | | | | | | | Comparative Example No. | |
| | 1 | 2 | 3 | 4 | 5 | 6 | 7 | 1 | 2 |
| Copolymer | TR-1 | TR-2 | TR-3 | TR-4 | TR-5 | TR-6 | TR-7 | TR-8 | TR-9 |
| Storage stability | 5 | 5 | 4 | 5 | 5 | 4 | 4 | 5 | 3 |
| Blow-off charge (μC/g) | 24.8 | 25.5 | 24.6 | 24.7 | 25.1 | 25.0 | 24.9 | 26.2 | 24.8 |
| Fixing temp. (°C.) | 140 | 150 | 140 | 150 | 150 | 130 | 120 | 190 | 110 |
| Offset temp. (°C.) | ≧240 | ≧240 | 240 | ≧240 | ≧240 | 240 | 230 | ≧240 | 130 |
| Image in early stage | Good | Good | Good | Good | Good | Good | Good | Severe dusting; and poor background | Offset (all over the surface) |
| Image after continuous copying test | Good | Good | Good | Good | Good | Good | Good | Poor* | Poor** |

*The background was dirty over the entire area, and the interior of the copier was polluted all over due to the dusting of toner.
**Offset was distinct all over the image areas and the background was not clean. Fringe effects were significant and the resolution in fine image areas was declined.

4. Evaluation of toner 4.1 Storage stability

About 5 g of the toner was placed in a glass Petri dish to form a layer of uniform depth and kept for 24 hours in a thermohygrostate of 55° C. and 90% RH. The toner was then screened through a 100 mesh metal sieve and the weight of the toner past through the sieve was measured and evaluated according to the following criteria.

| Rating scale | Weight % of toner particles passed through the sieve |
|---|---|
| 5 | More than 95 |
| 4 | 70 to 95 |
| 3 | 30 to 70 |
| 2 | 5 to 30 |
| 1 | Less than 5 |

4.2 Fixing characteristic and anti-offset properties

A testing copier, a modification of commercial copying machine SF 755 (Sharp Corp.), was loaded with a developer under test and an unfixed image was obtained, which was A-4 in size and one-third of which was solid black area. The unfixed image was tested by using a fixing tester with "Teflon" roll and varying the temperature from 100° to 240° C. at intervals of every 10° C., the linear speed being 900 cm/min. (about 30 sheets, A-4 in size, per minute). The optimum fixing temperature was determined by subjecting the fixed solid black area to adhesive tape peel test and noting the temperature at which the change in image densityiis 10% or less.

The incipient offset temperature was determined by noting the temperature at which the image density (ID) of an area on a white paper, where a part of solid black As is apparent from the foregoing description, the toner for electrophotography according to the present invention meets the requirements for toner such as storage stability, charge receptivity, and the like, is excellent in fixing characteristics as well as in anti-offset properties, and can be easily produced.

What is claimed is:

1. A toner for electrophotography containing as binder a polymer comprising as essential ingredient a high molecular weight monofunctional monomer of 1,000 to 50,000 in weight average molecular weight and having an ethylenic double bond at one end of the molecular chain.

2. A toner for electrophotography according to claim 1, wherein the high molecular weight monofunctional monomer is that obtained by the reaction of an active living polymer with a compound having an ethylenic double bond and a functional group capable of undergoing nucleophilic substitution reaction with said active living polymer.

3. A toner for electrophotography according to claim 1, wherein the high molecular weight monofunctional monomer is that containing in its molecule a polymer chain of styrene and/or a styrene derivative.

4. A toner for electrophotography according to claim 2, wherein the active living polymer is that obtained from styrene and/or a styrene derivative.

5. A toner for electrophotography according to claim 1, wherein the weight average molecular weight of the high molecular weight monofunctional monomer is 5,000 to 30,000.

6. A toner for electrophotography according to claim 1, wherein the polymer is that obtained by mixing 0.1 to 50% by weight of the high molecular weight monofunctional monomer and 50 to 99.9% by weight of other monomer copolymerizable with said high molecular weight monofunctional monomer to form 100% by weight of a mixture and polymerizing the resulting mixture.

7. A toner for electrophotography according to claim 1, wherein the polymer is that obtained by mixing 1 to 40% by weight of the high moeecular weight monofunctional monomer and 60 to 99% by weight of other monomer copolymerizable with said high molecular weight monofunctional monomer to form 100% by weight of a mixture and polymerizing the resulting mixture.

8. A toner for electrophotography according to claim 1, wherein the binder further comprises up to 99% by weight of other resins.

9. A toner for electrophotography according to claim 1, wherein the tone further contains a pigment and/or a magnetic powder.

10. A toner for electrophotography according to claim 8, wherein said other resins are selected from the group consisting of styrene resins, copolystyrene-acrylic resins, silicone resins, polyester-carbonate resins, xylene resins, epoxy resins, phenolic resins,ddiene-base resins, coumarone resins, amide resins and urethane resins.

11. A toner for electrophotography containing as a binder a polymer obtained by polymerizing a high molecular weight monofunctional monomer having a weight average molecular weight of 1,000 to 50,000 and having an ethylenic double bond at one end of the molecular chain with other monomer, copolymerizable with said high molecular weight monofunctional monomer, to provide a polymeric structure in which a high molecular weight side chain originated from the high molecular weight monofunctional monomer is attached as a branch to the main chain.

12. A toner for electrophotography according to claim 11, wherein the high molecular weight monofunctional monomer is that obtained by the reaction of an active living polymer with a compound having an ethylenic double bond and a functional group capable of undergoing nucleophilic substitution reaction with said active living polymer.

13. A toner for electrophotography according to claim 11, wherein the high molecular weight monofunctional monomer is that containing in its molecule a polymer chain of styrene and/or a styrene derivative.

14. A toner for electrophotography according to claim 12, wherein the active living polymer is that obtained from styrene and/or a styrene derivative.

15. A toner for electrophotography according to claim 11, wherein the weight average molecular weight of the high molecular weight monofunctional monomer is 5,000 to 30,000.

16. A toner for electrophotography according to claim 11, wherein the polymer is that obtained by mixing 0.1 to 50% by weight of the high molecular weight monofunctional monomer and 50 to 99.9% by weight of other monomer copolymerizable with said high molecular weight monofunctional monomer to form 100% by weight of a mixture and polymerizing the resulting mixture.

17. A toner for electrophotography according to claim 11, wherein the polymer is that obtained by mixing 1 to 40% by weight of the high molecular weight monofunctional monomer and 60 to 99% by weight of other monomer copolymerizable with said high molecular weight monofunctional monomer to form 100% by weight of a mixture and polymerizing the resulting mixture.

18. A toner for electrophotography according to claim 11, wherein the binder further comprises up to 99% by weight of other resins.

19. A toner for electrophotography according to claim 11, wherein the toner further contains a pigment and/or a magnetic powder.

20. A toner for electrophotography according to claim 18, wherein said other resins are selected from the group consisting of styrene resins, copolystyrene-acrylic resins, silicon resins, polyester-carbonate resins, xylene resins, epoxy resins, phenolic resins, diene-base resins, coumarone resins, amide resins and urethane resins.

* * * * *